US009752278B2

(12) United States Patent
Hawkinson et al.

(10) Patent No.: US 9,752,278 B2
(45) **Date of Patent: *Sep. 5, 2017**

(54) METHODS FOR TREATING SURFACES WITH SEALANT-CONTAINING POWDER

(71) Applicant: Cal-Tex Protective Coatings, Inc., Schertz, TX (US)

(72) Inventors: Rande Hawkinson, Garden Ridge, TX (US); Thomas Engelken, Schertz, TX (US); John E. Blount, New Braunfels, TX (US); Darin Klaehn, Seguin, TX (US)

(73) Assignee: Cal-Tex Protective Coatings, Inc., Schertz, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/376,706

(22) Filed: Dec. 13, 2016

(65) Prior Publication Data

US 2017/0089005 A1 Mar. 30, 2017

Related U.S. Application Data

(63) Continuation of application No. 14/935,537, filed on Nov. 9, 2015, now Pat. No. 9,551,107.

(60) Provisional application No. 62/077,649, filed on Nov. 10, 2014.

(51) Int. Cl.

| | |
|---|---|
| ***D06M 11/79*** | (2006.01) |
| ***D06M 15/256*** | (2006.01) |
| ***D06M 15/263*** | (2006.01) |
| ***D06M 15/277*** | (2006.01) |
| ***D06M 23/08*** | (2006.01) |
| ***D06M 23/12*** | (2006.01) |
| ***B05D 5/08*** | (2006.01) |
| ***B05D 3/12*** | (2006.01) |
| ***B05D 1/26*** | (2006.01) |
| ***B05D 1/28*** | (2006.01) |

(52) U.S. Cl.

CPC ..... *D06M 23/12* (2013.01); *B05D 1/26* (2013.01); *B05D 1/28* (2013.01); *B05D 3/12* (2013.01); *B05D 5/08* (2013.01); *B05D 5/083* (2013.01); *D06M 11/79* (2013.01); *D06M 15/256* (2013.01); *D06M 15/263* (2013.01); *D06M 15/277* (2013.01); *D06M 23/08* (2013.01); *B05D 2401/32* (2013.01); *B05D 2601/22* (2013.01); *D06M 2200/01* (2013.01); *D06M 2200/12* (2013.01)

(58) Field of Classification Search

CPC ... B05D 1/26; B05D 1/28; B05D 3/12; B05D 5/08; B05D 5/083; B05D 2401/32; B05D 2506/10; B05D 2601/22; D06M 23/12; D06M 15/256; D06M 15/263; D06M 11/79; D06M 23/08; D06M 15/277; D06M 2200/01; D06M 2200/12

USPC ..... 427/180, 368, 412, 429

See application file for complete search history.

(56) References Cited

U.S. PATENT DOCUMENTS

| | | | | |
|---|---|---|---|---|
| 4,274,883 | A | 6/1981 | Lumbeck | |
| 9,551,107 | B2 * | 1/2017 | Hawkinson | B05D 3/12 |
| 2002/0192367 | A1 | 12/2002 | Barbuzzi | |
| 2005/0205830 | A1 | 9/2005 | Oles | |
| 2007/0014970 | A1 | 1/2007 | Nun et al. | |
| 2010/0143422 | A1 | 6/2010 | Popplewell | |
| 2010/0247660 | A1 | 9/2010 | Lei | |
| 2011/0263037 | A1 | 10/2011 | Herz | |
| 2014/0044760 | A1 | 2/2014 | Lei | |
| 2014/0044761 | A1 | 2/2014 | Lei | |
| 2014/0106032 | A1 | 4/2014 | Dardelle et al. | |
| 2014/0220840 | A1 | 8/2014 | Koene et al. | |

FOREIGN PATENT DOCUMENTS

DE 10 2006 002553 A1 7/2007

OTHER PUBLICATIONS

International Search Report for PCT/US2015/059656, dated Feb. 9, 2016 (4 pages).
Evonik Industries, "Aerosil®: Emulsification Dry Water Solid Systems," Nov. 28, 2012 (29 pages).
Evonik Industries, "Aerosil® R 202," Jul. 2015 (2 pages).
Evonik Industries, "Aerosil® R 812," Jul. 2015 (2 pages).
Evonik Industries, "Sipernat® 22 S," Sep. 2015 (2 pages).
Evonik Industries, "Sipernat® 2200," Sep. 2015 (2 pages).
Evonik Industries, "Sipernat® 505," Apr. 2008 (2 pages).
Evonik Industries, "Specialty Silica," Jul. 2015 (17 pages).
Evonik Industries, "Successful Use of Aerosil® Fumed Silica in Liquid Systems," Sep. 2012 (12 pages).
Ystral Conti-TDS brochure, 2015, available at http://ystral.com/fileadmin/user_upload/Unternehmen/Broschueren/E-Conti-TDS.pdf.

* cited by examiner

*Primary Examiner* — William Phillip Fletcher, III
(74) *Attorney, Agent, or Firm* — Bookoff McAndrews, LLC

(57) ABSTRACT

Compositions comprising a liquid and fumed silica may be applied to surfaces as a sealant, e.g., to protect against damage or deterioration. The composition may be a powder, wherein a method of treating the surface includes applying pressure to the powder on the surface with an applicator, and the pressure releases the liquid sealant from the powder onto the surface. The liquid may comprise water and one or more polymers, such as a fluorocopolymer and a functionalized anionic polymer.

20 Claims, 2 Drawing Sheets

METHODS FOR TREATING SURFACES WITH SEALANT-CONTAINING POWDER

CROSS-REFERENCE TO RELATED APPLICATIONS

This application is a continuation of U.S. application Ser. No. 14/935,537, filed on Nov. 9, 2015, now U.S. Pat. No. 9,551,107, which claims benefit of priority from U.S. Provisional Application No. 62/077,649, filed on Nov. 10, 2014, each of which is incorporated by reference herein in its entirety.

TECHNICAL FIELD

The present disclosure relates to compositions for treating fabrics and other textiles. The present disclosure further relates to methods for making the compositions and methods for applying the compositions to fabrics and other textiles, e.g., as a sealant or protectant.

BACKGROUND

Sealants can provide protection to fabrics against various substances that may degrade and/or stain the fabric material in order to extend the life of fabrics, carpets, and other like materials. Such substances that can damage fabrics include water and organic substances (e.g., oil-based liquids or aerosols). Fabric sealants also may contain inhibitors to retain color or retard fading.

Current fabric sealants used for automotive upholstery are generally available in liquid form (e.g., solvent-based or water-based), and may be applied by means of a hand-held sprayer or tank sprayer with a wand, for instance. The application process may take several minutes to deposit a sufficient amount of sealant to cover and treat all of the fabric and carpeting in a vehicle. Typical dry times for such sprayed-on fabric sealants can range, for example, from 30 minutes to several hours, depending on various factors such as the amount of sealant applied and uniformity of coverage, the nature of the upholstery (e. LY product construction, types of materials used, etc.), and environmental conditions including the temperature and the relative humidity. Unless the fabric sealant is pre-applied, the application process will, in many cases, require the customer to bring the vehicle back to the dealership for sealant application and proper drying. Thus, the application process may inconvenience both customers and dealerships.

Moreover, because the typical application process involves spraying, a substantial amount of aerosolized fabric sealant can be wasted and lost to the surrounding air and never reach the fabric surface. This can present a potential health and/or environmental hazard. In addition, spraying and the resulting fabric sealant aeration may lead to unintended and/or undesirable deposit of fabric sealant onto non-fabric surfaces.

SUMMARY

The present disclosure includes a composition comprising a plurality of particles, each particle comprising: a liquid comprising water and at least two polymers each independently chosen from anionic polymers, anionic copolymers, fluoropolymers, fluorocopolymers, acrylic polymers, and acrylic copolymers; and fumed silica at least partially surrounding the liquid; wherein the composition comprises from about 3% to about 15% of the fumed silica by weight, with respect to the total weight of the composition. According to some aspects of the disclosure, a combined weight of the at least two polymers may comprise from about 5% to about 30% of the total weight of the liquid. At least one of the polymers may comprise perfluoroalkyl acrylate and/or at least one of the polymers may be a functionalized anionic polymer. In some examples, the liquid may comprise from about 3% to about 20% of at least one fluorocopolymer by weight, relative to the total weight of the liquid. Additionally or alternatively, the liquid may comprise from about 2% to about 10% of at least one anionic polymer by weight, relative to the total weight of the liquid.

According to some aspects of the present disclosure, the fumed silica may be hydrophobic. Further, in some aspects, the liquid of the composition may comprise from about 0.05% to about 0.25% of at least one UV-inhibitor by weight, relative to the total weight of the liquid. For example, the liquid may comprise about 0.25% of the at least one UV-inhibiter by weight, relative to the total weight of the liquid. The at least one UV-inhibitor may comprise titanium dioxide. According to some aspects, the liquid may comprise from about 85% to about 98% of water by weight, relative to the total weight of the liquid. The composition may be in the form of a powder, e.g., the fumed silica at least partially surrounding the liquid as mentioned above.

The present disclosure also includes a composition comprising a plurality of particles, each particle comprising a liquid and hydrophobic fumed silica at least partially surrounding the liquid; wherein the composition comprises from about 3% to about 15% of the hydrophobic fumed silica by weight, with respect to the total weight of the composition. The liquid may comprise from about 85% to about 98% of water by weight, a first polymer comprising about 3% to about 20% by weight, a second polymer comprising from about 2% to about 10% by weight, and at least one UV inhibitor comprising from about 0.05% to about 0.25% by weight, with respect to the total weight of the liquid.

The present disclosure further includes a method of treating a textile surface, comprising depositing a composition on the surface, wherein the composition comprises a plurality of particles, each particle comprising a liquid and fumed silica at least partially surrounding the liquid. The liquid may comprise water and at least two polymers each independently chosen from anionic polymers, anionic copolymers, fluoropolymers, fluorocopolymers, acrylic polymers, and acrylic copolymers. The composition may comprise from about 3% to about 15% of the fumed silica by weight, with respect to the total weight of the composition; and the composition may be in the form of a powder, such that the particles remain intact on the surface upon depositing the composition on the surface. The liquid may comprise at least one fluorocopolymer and at least one functionalized anionic polymer. For example, the at least one fluorocopolymer may be perfluoroalkyl acrylate. The liquid may comprise from about 3% to about 20% of the at least one fluorocopolymer by weight, and from about 2% to about 10% of the at least one functionalized anionic polymer by weight, with respect to the total weight of the liquid.

According to some aspects of the present disclosure, the method may further comprise brushing the deposited particles of the composition against the textile surface, such that at least a portion of the particles release the liquid onto the surface. The released liquid may, for example, be at least partially absorbed by the surface, such that the surface becomes wetted. In some examples of the method, the wetted textile surface may be dry within about 5 minutes.

BRIEF DESCRIPTION OF THE DRAWINGS

The accompanying drawings together with this specification illustrate and explain various aspects and principles of the disclosure. Wherever possible, the same reference numbers will be used throughout the drawings to refer to the same or like parts.

DETAILED DESCRIPTION

Figure 1:
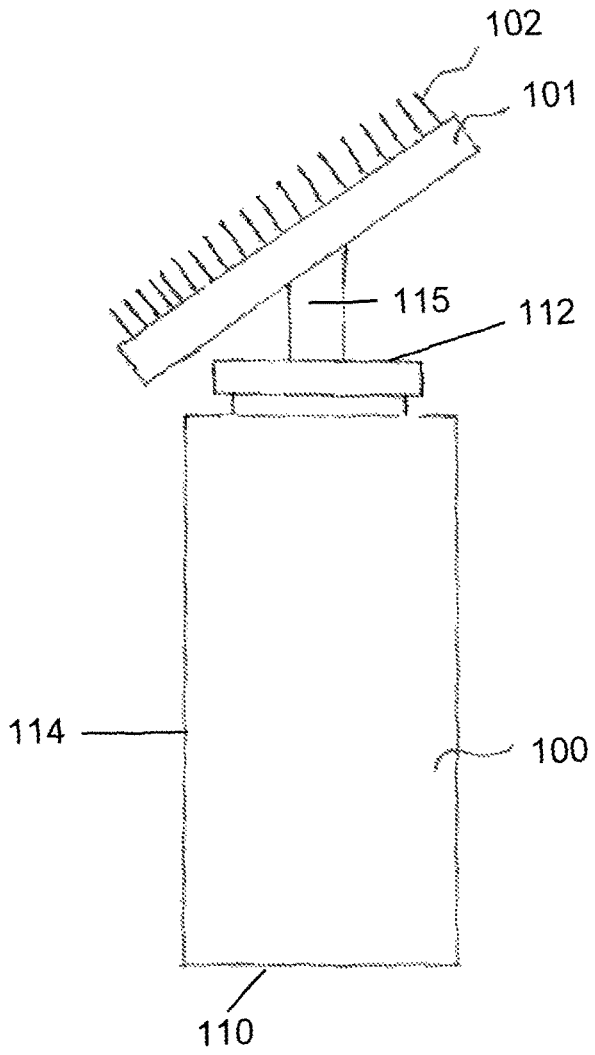
FIG. 1 shows an exemplary applicator in accordance with one or more embodiments of the present disclosure.

Particular aspects of the present disclosure are described in greater detail below. It is to be understood that both the foregoing general description and the following detailed description are exemplary and explanatory only, and are not restrictive of the fully scope of disclosure herein.

The singular forms "a," "an," and "the" include plural reference unless the context dictates otherwise. The term "about" refers to being nearly the same as a referenced number or value. As used herein, the term "about" is understood to encompass ±5% of a specified amount or value.

Compositions of the present disclosure may be useful in treating various fabric and other textile materials, e.g., as a sealant, to protect the surface of the material from damage and/or wear and tear over time. The compositions may be in particulate form, and may comprise a liquid in combination with silica. For example, the composition may be in particulate form, wherein the particles comprise liquid droplets mixed with, integrated into, and/or encapsulated by, silica, such as fumed silica, e.g., hydrophobic fumed silica The liquid droplets may be aqueous. For example, the liquid may comprise water and one or more polymers. In some embodiments, the liquid may comprise water, at least one first polymer, and at least one second polymer different from the first polymer. In some embodiments of the present disclosure, the amount of water in the liquid ranges from about 75% to about 99% by weight with respect to the total weight of the liquid, such as from about 80% to about 98% by weight, from about 85% to about 98% by weight, from about 87% to about 97% by weight, from about 88% to about 95% by weight, or from about 90% to about 92% by weight, with respect to the total weight of the liquid.

The polymer(s) of the composition may be synthetic or natural in origin, and may comprise anionic, cationic, and/or nonionic polymers or copolymers. Exemplary types of polymers suitable for the present disclosure include, but are not limited to, fluoropolymers, fluorocopolymers, acrylic polymers, acrylic copolymers, fluorochemical allophanates, fluorochemical polyacrylates, fluorochemical urethanes, fluorochemical carbodiimides, fluorochemical quanidines, and combinations thereof. In some embodiments, one or more polymers of the composition may be functionalized, e.g., such that the polymer(s) include at least one functional group. Exemplary functional groups include, but are not limited to, alkyl, alkene, alkyne, aldehyde, ketone, hydroxyl, carboxyl, halide, thiol, phosphate, amine, and other chemical functional groups known in the art. Non-limiting examples of polymers suitable for the present disclosure include, e.g., polytetrafluoroethylene and derivatives thereof, perfluoroalkyl acrylate and derivatives thereof, and products available under the trade names Masurf® CP-220, Masurf® FP622A, Masurf®, FS-230, Masurf® FP-610, Masurf® FP-920, and Masurf® FP-615C produced by Pilot Chemical/Mason Chemical; and AdvaPel® 732, AdvaPel® 770, and AdvaPel® 734 produced by Advanced Polymers, Inc.

In some embodiments, the liquid of the composition may comprise at least two polymers, e.g., at least one first polymer and at least one second polymer. The first and second polymers may be the same type of polymer or different types of polymers. For example, the at least one first polymer may be chosen from fluorocopolymers, fluoropolymers, functionalized anionic polymers, and derivatives thereof; and the at least one second polymer may be chosen from functionalized anionic polymers. In some embodiments, the at least one first polymer may comprise polytetrafluoroethylene or a derivative thereof, or perfluoroalkyl acrylate or a derivative thereof. In some embodiments, the at least one second polymer may be chosen from Masurf® SP-740, Masurf® CP-220, Masurf® FP622A, Masurf® FS-230, Masurf® FP-610, Masurf® FP-920 Masurf®, FP-615C, AdvaPel® 732, AdvaPel® 770, and AdvaPel® 736.

The total amount of polymer(s) in the liquid may range from about 1% to about 40% by weight, with respect to the total weight of the liquid, such as from about 2% to about 35% by weight, from about 5% to about 30% by weight, from about 8% to about 25% by weight, or from about 10% to about 20% by weight, with respect to the total weight of the liquid.

When the liquid comprises two or more polymers, the amount of each polymer may be the same or different from that of one or more of the other polymer(s). In some embodiments, for example, the liquid may comprise a first polymer and a second polymer present in equal amounts, e.g., about 5% by weight, about 10% by weight, about 15% by weight, or about 20% by weight, with respect to the total weight of the liquid. In some embodiments, the liquid may comprise different amounts of the first polymer and the second polymer. The amount of each of the first polymer and the second polymer may range from about 0.5% to about 25% by weight, such as from about 1% to about 20% by weight, from about 2% to about 10% by weight, from about 3% to about 20% by weight, from about 3% to about 10% by weight, or from about 5% to about 15% by weight, with respect to the total weight of the liquid. In some embodiments, the amount of the at least one first polymer ranges from 3% to 20%, by weight, with respect to the total weight of the liquid; and the amount of the at least one second polymer ranges from 2% to 10% by weight, with respect to the total weight of the liquid.

In some embodiments, the liquid many comprise one or more additional ingredients or agents. For example, the liquid may comprise a fragrance (or fragrance agent) and/or at least one UV-inhibitor. In some embodiments, the amount of the at least one UV-inhibitor ranges from about 0.01% to about 0.10% by weight, such as about 0.05% by weight, with respect to the total weight of the liquid. Examples of UV-inhibitors suitable for the compositions herein include, but are not limited to, titanium dioxide ($TiO_2$), avobenzones, benzophenones, para-aminobenzoates, anthranilates, salicylates, cinnamates, pyrrones, benzimidazoles, carbazoles, napholsulfonates, and quinine disulfate. Non-limiting examples of avobenzones include products available under the trade names PARSOL® 1789, Eusolex® 9020, and Escalol® 517. Non-limiting examples of benzophenones include benzophenone-4,4-hydroxybenzophenone, and 2,4-dihydroxybenzophenone.

In some embodiments, the liquid may comprise a liquid fabric sealant. In some embodiments, for example, the liquid may comprise RESISTALL® NG™ produced by CalTex Protective Coatings, Inc. Other liquid sealants used for commercial and/or private purposes may be used as the liquid or a component of the liquid of the compositions disclosed herein. Such liquid sealants may include, e.g., liquid sealants formulated for application to vehicle upholstery and other interior surfaces such as seats, panels, headliners, and carpet, or for application to residential or commercially-used carpet and/or furniture.

As mentioned above, the composition may comprise liquid droplets in combination with silica, such as fumed silica, e.g., hydrophobic fumed silica. Non-limiting examples of hydrophobic fumed silicas that may be used in the compositions include, but are not limited to, products available under the trade names AEROSIL® R 202, AEROSIL® R-208, AEROSIL® R 812 S, AEROSIL® R 816, and AEROSIL® R 972 produced by Evonik. In some embodiments, the composition may comprise fumed silica that is at least partially hydrolyzed or precipitated, such that the fumed silica is at least partially hydrophilic. Non-limiting examples of hydrolyzed/hydrophilic fumed silicas suitable for the present disclosure include, but are not limited to, SIPERNAT® fumed silicas produced by Evonik. The fumed silica(s) may have a relatively high surface area (e.g., a specific surface area (BET) within a range of about 75 $m^2/g$ to about 300 $m^2/g$).

Precipitated silica (e.g., SIPERNAT®) is produced by first combining sodium silicate and a mineral acid, and then washing the combination with water. Particle sizes typically range between 20 nm and 300 nm. Precipitated silica may absorb most polar and non-polar liquids comprising 50-75% of the liquid actives. The physical absorption mechanism may be independent of the chemical characteristics of the liquid being absorbed. The finished absorbate may comprise between 50% and 75% of the liquid actives.

In some embodiments, the liquid droplets may be at least partially or completely surrounded (e.g., encapsulated) by the silica. For example, the composition may comprise a plurality of particles, each comprising an inner liquid component (e.g., liquid droplet or core) partially or completely surrounded by an outer component (or shell) of hydrophobic fumed silica. The composition may be in the form of a powder, e.g., a dry, loose powder comprising separated, finely-divided particles that may be deposited on the surface of fabrics and other textiles by shaking the powder over the surface.

Without being bound by theory, it is believed that hydrophobic fumed silica does not absorb the liquid, which is water-based, but rather is attracted to (and/or bonds to) the surface of the liquid droplets. The liquid droplets therefore may have an appropriate minimum surface tension in order for the attraction or bond between the fumed silica and the liquid to form. For example, if the surface tension of the liquid droplets is below the appropriate minimum surface tension, the fumed silica and the liquid may form a colloid, such as a cream. If, however, the surface tension of the liquid droplets is at or above the appropriate minimum surface tension, the fumed silica may partially or completely surround individual liquid droplets to form a dry powder.

Further without being bound by theory, it is believed that hydrophilic fumed silica may include surface pores and/or internal pores, such that a liquid (e.g., an aqueous mixture) may be absorbed into and/or adsorbed onto the fumed silica. Thus, a liquid mixed with hydrophilic fumed silica may be sufficiently absorbed/adsorbed so that the combination of hydrophilic fumed silica and liquid forms a dry powder. The absorbed/adsorbed liquid may only be temporarily contained within the pores of the fumed silica, and capable of being washed out upon contact with another liquid.

In some embodiments, the composition may comprise from about 1% to about 35% fumed silica by weight, with respect to the total weight of the composition. For example, the composition may be in particulate form, comprising from about 1% to about 30% by weight, from about 1% to about 25% by weight, from about 2% to about 20% by weight, from about 3% to about 15% by weight, from about 5% to about 13% by weight, or from about 7% to about 10% by weight of silica, with respect to the total weight of the composition. The composition may comprise silica particles having an average diameter ranging from about 5 nm to about 300 nm, such as from about 5 nm to about 50 nm, or from about 20 nm to about 300 nm.

In some embodiments, the composition may comprise two or more different types of fumed silicas. For example, various components of a liquid fabric sealant may be divided between two or more fumed silicas, e.g., to facilitate applying the sealant composition to a fabric surface. In some embodiments, the composition may comprise a first set of particles comprising a first fumed silica in combination with a first liquid, and a second set of particles comprising a second fumed silica in combination with a second liquid. Each of the first liquid and the second liquid may comprise a mixture of water, one or more polymers (including, but not limited to, any of the polymers mentioned above), and/or one or more additional ingredients or agents (e.g., a UV-inhibitor, a fragrance, an odor-reducing agent, etc.). The first liquid may be the same as the second liquid, or may be different.

The chemical composition of the first and second liquids may be selected based at least in part on compatibility with the respective first or second fumed silica with which they are combined. For example, the first liquid to be combined with hydrophobic fumed silica may comprise a higher concentration of polymer(s) than the second liquid to be combined with hydrophilic fumed silica. Similarly, the second liquid to be combined with the hydrophilic fumed silica may comprise a higher amount of water than the first liquid to be combined with the hydrophobic fumed silica. Further, agents such as UV-inhibitors, fragrances, or odor-reducing agents may be relatively more compatible with a hydrophilic material or hydrophobic material. Thus, for example, the second liquid may comprise a UV-inhibitor, while the first liquid does not comprise a UV-inhibitor. Compositions of the present disclosure therefore may allow for components best suited to a hydrophobic environment to be combined with components best suited to a hydrophilic environment. Further, this type of multi-part composition may allow for the combination of different liquids only at the point of application/fabric treatment (see discussion below).

The first set of particles and the second set of particles each may be a dry powder, such that, when the first and second sets of particles are mixed together, the resulting composition is in the form of a dry powder. In some embodiments, the first fumed silica may be a relatively hydrophobic fumed silica (such as, e.g., products under the trade name AEROSIL®, as mentioned above). Thus, for example, the first set of particles may comprise hydrophobic fumed silica that at least partially or fully surrounds a droplet of the first liquid as discussed above. In some embodiments, the second fumed silica may be a relatively hydrophilic fumed silica (such as, e.g., products under the trade name SIPERNAT®, as mentioned above). Thus, for example, the second set of particles may comprise hydrophilic fumed silica, wherein the second liquid is adsorbed onto and/or absorbed into pores of the that hydrophilic silica.

In some embodiments, the first liquid may comprise only components that are water-based or water soluble components for combination with a hydrophobic fumed silica (e.g., AEROSIL® or other fumed silica that is at least partially hydrophobic), and the second liquid may comprise components that are polar, non-polar, oil-based, water-based or water soluble, or any mixture thereof, for combination with a hydrophilic fumed silica (e.g., SIPERNAT® or other fumed silica that is at least partially hydrophilic).

The first and second set of particles may be applied to a surface separately, or may be mixed together for application. The ratio of first set of particles to second set of particles by weight may range from about 0.2 (i.e., 1:5) to about 1.5 (i.e., 3:2), such as from about 0.5 to about 1.1, from about 0.6 to about 1, or from about 0.7 to about 0.9. For example, the weight ratio of the first set of particles to the second set of particles may be about 0.2, about 0.3. about 0.4, about 0.5, about 0.6, about 0.7, about 0.8, about 0.9, about 1.0, about 1.1, about 1.2, about 1.3, about 1.4, or about 1.5.

The compositions disclosed herein may be used to treat the surfaces of a variety of fabrics and other textiles. For example, compositions of the present disclosure may be applied to cloth, vinyl, leather, and other fibers and fabrics used for interior seats, door panels, dashboards, and trims in automotive vehicles. The compositions herein may be used to treat fabrics and textiles in other products and in other industries. For example, the compositions herein may be useful in treating upholstery of furniture that is periodically or routinely exposed to the outdoor environment and/or furniture subject to frequent use in public spaces (e.g., restaurants, hotels, offices, etc.). Treating a surface by application of the compositions disclosed herein may improve resistance to moisture and/or stains, and may prevent or impede discoloration, and/or loss of color.

The compositions disclosed herein may be applied to a surface by any suitable method. In some embodiments, an applicator may be used to apply the composition. FIG. 1 shows an exemplary applicator suitable for applying the composition to a surface, e.g., for protecting the surface by sealing fabric at its surface. As shown, the applicator includes a container 100 attached to a perforated brush head 101 having bristles 102. The brush head 101 may be fixedly or removably attached to the container 100. The container 100 may have one or more openings for adding the composition to the container 100. In some embodiments, for example, the container 100 may have an opening in the bottom wall 110 of the container 100, opposite the top wall 112 to which the brush head 101 is attached (opening not shown in FIG. 1). The opening may be closeable by a cap, for example, a flip-top, snap-on, or screw-threaded cap. The container 100 may be configured to contain any suitable volume, such as, e.g., 6 oz., 12 oz., or 20 oz. or more.

The brush head 101 may include perforations sufficiently large to permit the composition particles to exit the container and contact the bristles 102.The brush head 101 may have any suitable shape such as, e.g., generally rectangular. In at least one embodiment, the brush head 101 is about 4 inches in width by about 3 inches in depth (with a height suitable for mounting the bristles 102). In another embodiment, the brush head 101 is about 4 inches in width by about 2 inches in depth (with a height suitable for mounting the bristles 102). The brush head 101 may include perforations sufficiently large to permit the composition particles to exit the container and contact the bristles. The bristles 102 may be relatively stiff, e.g., comprising metal, metal alloy, or other material that may be formed into sufficiently stiff bristles, such as plastic. The bristles may range from about 0.5 inches to about 1.5 inches long, e.g., about 1 inch long.

To apply the composition to a fabric surface, the container 100 may be inverted such that the composition particles pass through the brush head 101's perforations and travel down the brush bristles 102 towards the surface. The bristles 102 then may be swept across the surface to deposit the composition. As the composition contacts the surface, friction between the bristles 102 and the surface may rupture at least a portion of the composition particles to release liquid for treating the surface. Without being bound by theory, for particles comprising hydrophobic fumed silica in combination with a liquid, it is believed that friction from the brush bristles 102 may at least partially break apart the hydrophobic fumed silica component to release the liquid (e.g., inner liquid core as discussed above) onto the surface to be treated. Following release of the liquid, the fabric surface thus treated with the composition may be mildly damp to the touch before drying. For compositions comprising two set of particles as described above (e.g., a first set of particles comprising hydrophobic fumed silica in combination with a first liquid, and a second set of particles comprising hydrophilic fumed silica in combination with a second liquid), it is believed that release of the first liquid upon breaking apart the hydrophobic fumed silica component of the first set of particles may facilitate release of the second liquid from the pores of the hydrophilic fumed silica. Thus, the first and second liquids may combine upon release for deposition onto the fabric surface. In order to release most or substantially all of the second liquid absorbed in the hydrophilic fumed silica, the first liquid may comprise at least 70% water by weight with respect to the hydrophilic fumed silica.

The surface of the fabric thus treated with liquid(s) may dry relatively quickly, such as within about 10 minutes, e.g., in less than 7 minutes, less than 5 minutes, or less than 3 minutes. The compositions disclosed herein may dry faster than conventional liquid sealants due to the ability to control deposition/release of the liquid, and the ability to use less liquid.

In some embodiments, the brush head 101 may be angled relative to the container 100, e.g., the top wall 112 of the container 100. For example, the brush head 101 may be connected to the container 100 via a rod 115 as illustrated in FIG. 1. The connecting rod 115 may allow the brush head 101 to move, e.g., rotate or pivot, relative to the container 100. In this way, as the brush head 101 moves over the various contours of a fabric surface or other textile surface, the bristles 102 may remain in contact with the surface to deposit the composition as the container 100 remains inverted to allow a gravity feed of the particles. The movable connection may be accomplished by any suitable pivot, ball and socket arrangement, hinge, cantilever, etc. between the brush head 101 and the connecting rod 115. In some embodiments, the brush head 101 may be in a fixed configuration parallel to the top wall 112 of the container 100, e.g., fixedly attached to the container 100 via a rod 115 without a movable connection. In some embodiments, the brush head 101 may be flush against the surface of the container 100, e.g., against the top wall 112 or a side surface 114 of the container 100.

Figure 2A:
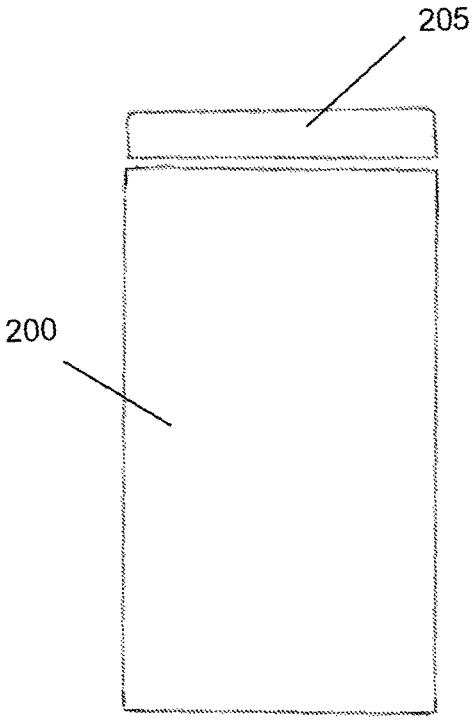
FIGS. 2A-2C show another exemplary applicator, in accordance with one or more embodiments of the present disclosure
Figure 2B:
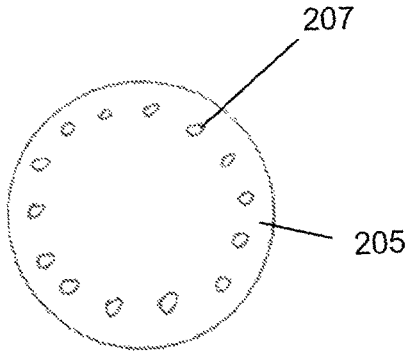
Figure 2C:
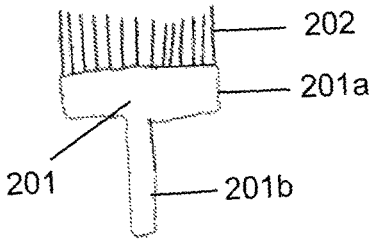

FIGS. 2A-2C illustrate another exemplary applicator that may be used to deposit the composition on a surface. As shown, the applicator includes a container 200 (see FIGS. 2A and 2B) and a brush 201 (see FIG. 2C) as separate components. The container 200 may include a cap 205 comprising one or more perforations 207 to allow the composition to exit the container 200. The perforations 207 may be generally circular, or any other suitable shape, and may be arranged in a generally circular configuration proximate the perimeter of the cap 205 as shown in the top view of the cap 205 in FIG. 2B, or any other suitable arrangement. For example, the perforations 207 may be located towards the center of the cap 205, arranged in concentric circles, arranged in one or more rows and/or columns, or have a star-shaped configuration or other arrangement.

The cap 205 may be fixedly or removably attached to the container 200. For example, the cap 205 may be secured to the container 205 via threads, a snap-on connection, flip-top connection, or other suitable connection, that may allow the cap 205 to move to expose the inside of the container 200 for adding the composition to the container 200. In some embodiments, the cap 205 may be permanently adhered to the end of the container 200 or may form an integral part of the container 200. In such cases, the container 200 may include one or more other openings similar to the container 100 of FIG. 1 discussed above, for adding the composition. The container 100 may be configured to contain any suitable volume, such as, e.g., 6 oz., 12 oz., or 20 oz. or more.

The brush 201 may include a brush head 201*a* and a handle 201*b*. The brush head 201*a* may have any suitable shape such as, e.g., generally rectangular as shown in FIG. 2C. In some embodiments, for example, the brush head 201*a* may be about 4 inches in width by about 2 or 3 inches in depth (with a height suitable for mounting the bristles 201). The brush head 201*a* may be attached to, or integral with, the handle 201*b*. The bristles 202 may include any of the features of the bristles 102 of FIG. 1 discussed above.

To apply the composition to a fabric surface or other textile surface, the container 200 may be inverted and shaken such that the composition particles pass through the perforations 207 to dust the surface with the composition. The brush 201 then may be swept across the surface and composition to brush the composition into the fibers of the fabric/textile surface with the bristles 202, in a similar manner as discussed above for the brush head 101 and bristles 102 of FIG. 1.

As an alternative to a brush head being used as an applicator, a porous, sponge-like material may be used. For example, a sponge may be attached to the container 100 of the applicator shown in FIG. 1 in place of the brush head 101. The sponge may be sufficiently porous to permit the composition to pass from the container 100 through the sponge to reach the fabric/textile surface. By applying sufficient pressure on the surface with the sponge, the composition particles may break to release the liquid onto the surface.

In some embodiments, the compositions may be produced by preparing the liquid (e.g., liquid sealant) and then combining the liquid with fumed silica. For example, water may be combined with one or more polymers (e.g., at least one first polymer, and at least one second polymer) to form a liquid. The liquid may include more or fewer components, as desired for the particular application. Non-limiting examples of such components may include, but are not limited to, at least one UV-inhibitor and/or at least one fragrance. In some embodiments, for example, the liquid may be prepared by combining water with an acrylate polymer such as perfluoroalkyl acrylate, a functionalized anionic polymer, and $TiO_2$ or benzophenone-4.

The liquid sealant then may be combined with fumed silica and thoroughly mixed to form a dry powder mixture. Mixing may be performed in a high speed, high shear mixer such as a rotor stator system for a period of time until a dry powder forms. In some embodiments, a powder induction mixer such as the Ystrale® Conti-TDS (Transporting and Dispersing System) and other high shear mixers may be used, e.g., to assist in dispersing the fumed silica powder into the liquid sealant. For example, the mixer may include two feed lines, one for each of the liquid and the fumed silica powder, that meet in a mixing chamber. Once inside the mixing chamber, the liquid and fumed silica may be subjected to shear forces and combined under vacuum to yield the composition in particulate form. The composition may exit the mixing chamber through an outlet. The mixer may be used to produce the composition in batches or in a continuous production line.

In general, the liquid and fumed silica may be mixed at a speed ranging from about 2500 rpm to about 3800 rpm. For example, the liquid and fumed silica may be mixed at a speed ranging from about 2600 rpm to about 3600 rpm, such as from about 2800 rpm to about 3400 rpm, e.g., from about 3000 rpm to about 3200 rpm. In some embodiments, the liquid and fumed silica may be mixed at an average speed of about 2800 rpm, about 3000 rpm, about 3200 rpm, or about 3400 rpm. The appropriate mixing time may be determined based on the characteristics of the liquid, fumed silica, and the relative amounts of each. For example, suitable mixing times may range from about 1 minute to about 20 minutes, e.g., from about 5 minutes to about 15 minutes. In some cases, shorter mixing times may be insufficient to achieve integration of the liquid and fumed silica, and longer mixing times may cause the structure of the composition to begin to break down. The liquid and fumed silica may be mixed at room temperature or any other suitable temperature (e.g., such that the liquid remains in liquid form).

In some embodiments, the composition may comprise from about 1% to about 25% of fumed silica by weight, with respect to the total weight of the composition, such as from about 3% to about 15% by weight, e.g., from about 5% to about 12% by weight, or from about 7% to about 10% by weight, with respect to the total weight of the composition. In some embodiments, the weight ratio of fumed silica to liquid in the composition may range from 1:50 to 1:4, from 1:35 to 1:7, or from 1:25 to 1:10 (fumed silica:liquid).

The present disclosure is presented to enable a person skilled in the art to make and use the compositions described herein, with various examples provided for illustration purposes. Various modifications to the disclosed examples will be readily apparent to those skilled in the art in view of the generic principles discussed herein without departing from the spirit and scope of the disclosure. Thus, the present disclosure is not intended to be limited to the examples described, but is to be accorded the widest scope consistent with the principles and features disclosed herein.

Other than in the following examples, or where otherwise indicated, the numerical parameters set forth in the specification and claims are to be understood as approximations (e.g., being modified by the term "about") that may vary depending upon the desired properties sought to be obtained by the present invention.

The following examples are intended to illustrate the present disclosure without, however, being limiting in nature. It is understood that the present disclosure encompasses additional embodiments consistent with the foregoing description and following examples.

EXAMPLES

Example 1

A sealant composition was prepared by adding 16 grams of hydrophobic fumed silica (AEROSIL® R 202) to 200 grams of liquid fabric sealant (RESISTALL® NG™ fabric sealant), providing for 8% fumed silica by weight, with respect to the total weight of the composition. RESISTALL® NG™ fabric sealant liquid comprises water, 0.5% perfluoroalkyl acrylate by weight, 3.0% functionalized anionic polymer by weight, and 0.5% benzophenone-4 by weight, with respect to the total weight of the liquid. The fumed silica and liquid fabric sealant were mixed in a high speed, high shear mixer (Ystral® Conti-TDS) for about 5 minutes at room temperature, at which point the composition formed a dry powder.

Example 2

The drying time of the sealant composition from Example 1 was compared to the drying time of a commercial liquid fabric sealant (RESISTALL® NG™ fabric sealant).

Samples of the sealant composition from Example 1 and of RESISTALL® NG™ fabric sealant each were applied to interior upholstery of a car seat made of 100% polyurethane. For each experiment, the sealant composition from Example 1 was shaken from a container having a perforated top out onto the surface of the car seat, such that about 1.2 g of the composition was spread across about 1 $ft^2$ surface area. The sealant composition deposited on the fabric of the car seat then was brushed against the fabric surface with firm bristles of a brush, which caused the surface to wet. At approximately the same time the Example 1 composition was applied, about 3.9 g of the RESISTALL® NG™ liquid fabric sealant was sprayed across about 1 $ft^2$ surface area of a separate portion of the same fabric surface of the car seat, which caused the surface to wet upon contact. The 1.2 g sample of the Example 1 composition and the 3.9 g sample of the RESISTALL® NG™ liquid fabric sealant typically provide the same results (e.g., roughly the same level of treatment) for a given fabric surface. Since the RESISTALL® NG™ liquid fabric sealant is aerosolized, a portion of the aerosol does not reach the surface.

Two experiments were conducted while the car was inside a garage (9:00 am and 1:30 pm), and one experiment was conducted while the car was parked outside (10:30 am). Upon the initial wetting, each fabric surface was allowed to dry at room temperature (about 25° C.) and atmospheric pressure. Each surface was monitored for wetness to the touch at 1-minute increments. Results are shown in Table 1.

TABLE 1

Drying times

| Location | Application time | Example 1 composition (min:sec) | RESISTALL ® NG ™ fabric sealant (min:sec) |
|---|---|---|---|
| Inside | 9:00 am | 3:40 | 13:50 |
| Inside | 1:30 pm | 7:30 | 32:00 |
| Outside | 10:30 am | 4:20 | 19:30 |

The composition from Example 1 was observed to have dried within 5 minutes, while the commercial liquid fabric sealant had dried after about 20 minutes.

What is claimed is:

1. A method of treating a surface, the method comprising:

applying pressure to a powder on the surface with an applicator, wherein the powder comprises:

a liquid sealant comprising water and at least two polymers chosen from anionic polymers, anionic copolymers, fluoropolymers, fluorocopolymers, acrylic polymers, and acrylic copolymers, and combinations thereof; and fumed silica;

wherein the pressure releases the liquid sealant from the powder onto the surface.

2. The method of claim 1, wherein the powder is dry before the pressure is applied.

3. The method of claim 1, wherein the applicator comprises a brush or a sponge.

4. The method of claim 1, wherein applying pressure to the powder includes sweeping the surface with a brush or a sponge.

5. The method of claim 1, further comprising depositing the powder on the surface from a container.

6. The method of claim 1, wherein the powder comprises particles comprising the liquid sealant at least partially encapsulated by the fumed silica, and applying pressure to the powder causes the particles to release the liquid sealant onto the surface.

7. The method of claim 1, wherein the liquid sealant is at least partially absorbed by the surface after the liquid sealant is released from the powder.

8. The method of claim 1, wherein a combined weight of the at least two polymers comprises from about 5% to about 30% of the total weight of the liquid sealant.

9. The method of claim 1, wherein the liquid sealant comprises from about 3% to about 10% perfluoroalkyl acylate by weight, with respect to the total weight of the liquid sealant.

10. The method of claim 1, wherein the powder comprises from about 2% to about 20% of the fumed silica by weight, with respect to the total weight of the powder.

11. The method of claim 1, wherein the liquid sealant comprises from about 85% to about 98% of water by weight, with respect to the total weight of the liquid sealant.

12. The method of claim 1, wherein the surface is an interior surface of a vehicle.

13. A method of treating a surface, the method comprising:

applying pressure to a dry powder on the surface by sweeping an applicator across the dry powder and the surface;

wherein the dry powder comprises droplets of a liquid sealant at least partially surrounded by fumed silica, the liquid sealant comprising water, a first polymer, and a second polymer different from the first polymer, each of the first and second polymers being an anionic polymer, an anionic copolymer, a fluoropolymer, a fluorocopolymer, an acrylic polymer, or an acrylic copolymer; and wherein the pressure releases at least a portion of the liquid sealant from the fumed silica onto the surface.

14. The method of claim 13, wherein the liquid sealant is formulated to treat vehicle upholstery.

15. The method of claim 13, wherein the applicator includes a brush or a sponge.

16. A method of treating a surface inside a vehicle, the method comprising:

applying pressure to a powder on the surface via an applicator, wherein the powder comprises droplets of a liquid sealant at least partially surrounded by fumed silica such that the powder is dry, the liquid sealant comprising:

a first polymer chosen from an anionic polymer, an anionic copolymer, a fluoropolymer, a fluorocopolymer, an acrylic polymer, or an acrylic copolymer;

a second polymer different from the first polymer; and from about 85% to about 98% water by weight, with respect to the total weight of the liquid sealant;

wherein the pressure releases at least a portion of the liquid sealant from the fumed silica onto the surface.

17. The method of claim 16, further comprising depositing the powder on the surface before applying pressure to the powder.

18. The method of claim 17, wherein the powder is deposited on the surface with the applicator.

19. The method of claim 16, wherein the liquid sealant released from the powder is at least partially absorbed by the surface and serves to protect the surface.

20. The method of claim 16, wherein the first polymer comprises perfluoroalkyl acylate, and the second polymer comprises an anionic polymer including at least one functional group chosen from alkyl, alkene, alkyne, aldehyde, ketone, hydroxyl, carboxyl, halide, thiol, phosphate, and amine groups.

* * * * *